US005311616A

United States Patent [19]

Pratt

[11] Patent Number: 5,311,616

[45] Date of Patent: May 10, 1994

[54] BODY FRESHENER

[76] Inventor: Barbara A. Pratt, P.O. Box 1478, Crystal Beach, Tex. 77650

[21] Appl. No.: 991,394

[22] Filed: Dec. 16, 1992

[51] Int. Cl.[5] ..... H05B 1/02; F24H 3/04; F24H 3/02; A47K 10/48

[52] U.S. Cl. ..... 392/394; 219/494; 34/90; 392/392; 392/386

[58] Field of Search ..... 219/494; 392/386, 392, 392/394, 396, 404; 34/90.97

[56] References Cited

U.S. PATENT DOCUMENTS

| | | | |
|---|---|---|---|
| 3,449,838 | 6/1969 | Chancellor | 34/90 |
| 3,903,883 | 9/1975 | Peciha et al. | 219/502 |
| 3,949,743 | 4/1976 | Sharbrom | 128/368 |
| 4,003,967 | 1/1977 | Potvin | 261/30 |
| 4,195,416 | 4/1980 | Hall | 34/90 |
| 4,383,377 | 5/1983 | Crafton | 34/60 |
| 4,529,867 | 7/1985 | Velnosky et al. | 219/274 |
| 4,780,595 | 10/1988 | Alban | 219/370 |
| 4,804,821 | 2/1989 | Glucksman | 219/271 |
| 4,910,384 | 3/1990 | Silver | 219/271 |

*Primary Examiner*—Mark H. Paschall

*Attorney, Agent, or Firm*—Richard L. Moseley; Albert B. Dallas

[57] ABSTRACT

A body freshener is provided which performs several function. Air may be directed at the body for cooling. The air may be heated for drying or for comfort. The air may carry various fragrances or lotions as desired to be applied to the body of the user.

4 Claims, 3 Drawing Sheets

BODY FRESHENER

BACKGROUND OF THE INVENTION

1. Field of the Invention

This invention relates to a combination body dryer, moisturizer, suntan oil and fragrance dispenser for use in the home, office or a place of business. The body freshener is a convenient and efficient system for drying the body after a shower, swim, etc. The body freshener essentially replaces the need for towel drying and the associated maintenance costs. Alternatively, the body freshener may be used for applying sun tan oils, water, or fragrances before exposure to the sun.

2. Description of Related Art

Electric body dryers and fragrance dispensers are known in the art. However, the prior art lacks a device such as the body freshener that combines a body dryer, moisturizer, sun tan oil and fragrance dispenser into a single unit.

The need for body fresheners is demonstrated in the art in as disclosed in various patents.

U.S. Pat. No. 3,449,838 shows a combination wall mounted dryer and heater for using heating air for discharge into a room or hair drying.

U.S. Pat. No. 4,195,416 shows a combination hair/-hand/body dryer and vapor dispenser. The unit may be wall mounted in a cabinet with a hair dryer. The suitable vaporizing substance is disposed adjacent to the inlet of the hair dryer and then expelled with the heated air.

U.S. Pat. No. 4,383,377 shows a hot air dryer room deodorizer for use in rooms and restrooms. A vaporizable deodorizer is disposed over the air intake to a hot air dryer, such that the intake air is drawn through the deodorizer and into the hot air dryer itself and then exhausted from the hot air dryer into the room.

U.S. Pat. No. 4,780,595 shows a body drying apparatus having a fan, heating element, air vents, and air nozzle. Two operating switches enable an operator to select one of several flow rates and temperatures.

U.S. Pat. No. 4,804,821 discloses an aroma diffuser assembly having a heating element for effecting the release of an aroma from a contained aroma producing material.

Although electric body dryers are disclosed in the prior art, a means for delivering fragrances by a forced draft blower are not known. The use of an aspirator device to produce a vacuum that enables a suction to draw the liquid substance into the discharge of a blower is not found in the art. As the prior art discloses a fragrance substance located at the air intake of a blower for propulsion through the blower.

SUMMARY OF THE INVENTION

This invention relates to a combination body dryer, water, suntan oil and fragrance dispenser for use in the home, office or a place of business. The operator may select from a front mounted switch box a combination of air, heat, water, suntan oil and fragrances as desired. An aspirator is used to dispense water, suntan oils or a fragrance into a stream of air produced from a blower. A series of vents distribute the air mixture to the operator who stands in front of the unit. The unit may be free standing or wall mounted as desired.

DESCRIPTION OF THE PREFERRED EMBODIMENTS

The body freshener is a convenient and efficient as a replacement for towel drying. The body freshener reduces maintenance costs and improve unsanitary conditions associated with towel drying, particularly in locker rooms, hotels, and public washrooms. The body freshener is quite useful before exposure to the sun as it has the capability to apply suntan oils to the skin. During sun bathing the body freshener may be used to apply additional suntan oils, or water to the skin to moisturize and refresh the skin. After a swim, shower, or bath, the body freshener may be used to dry the body and if desired to apply a fragrance. The body freshener is capable of a multitude of uses. The body freshener is capable of dispensing liquid substances to the body in a vapor form. Therefore, the body freshener may be used with a wide variety of liquid substances as desired. These include but are not limited to suntan oils, water, fragrances, moisturizers, skin lotions, etc.

Figure 1:
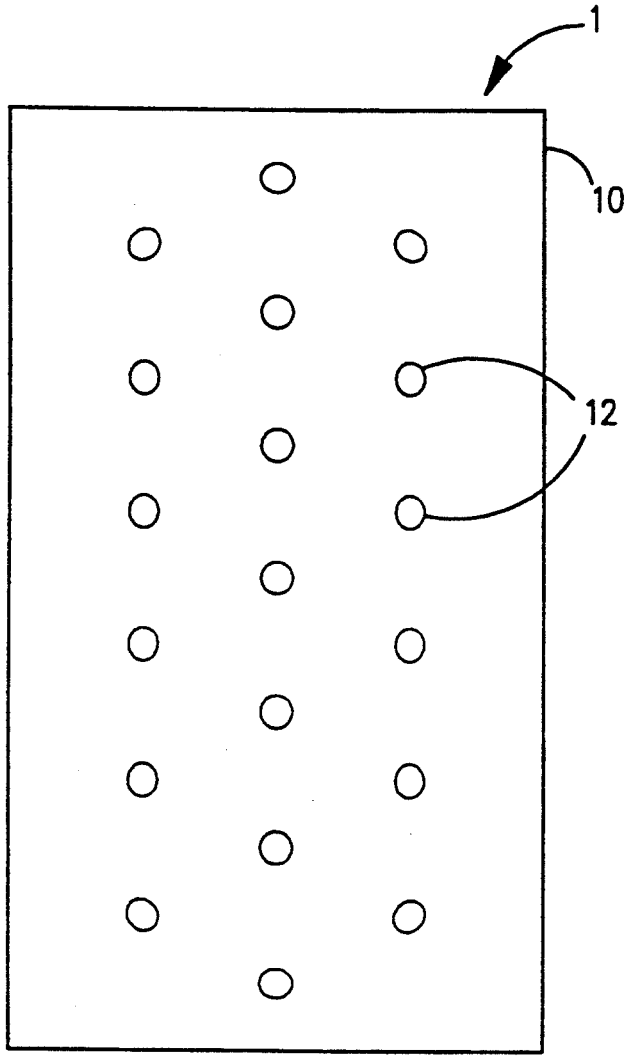
FIG. 1 is a front view of the body freshener.
Figure 2:
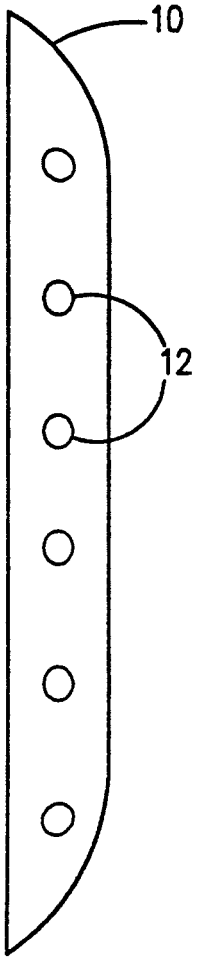
FIG. 2 is a side view of the body freshener.
Figure 3:
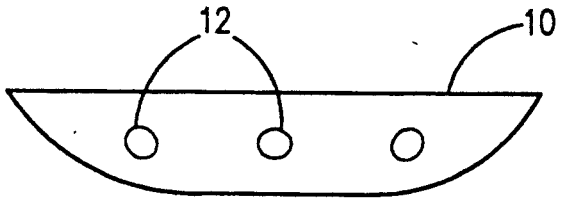
FIG. 3 is a top view of the body freshener.

The body freshener 1 is generally depicted in FIGS. 1-3. The body freshener is shown to include an enclosure 10 that is free standing or capable of attachment to a wall. The enclosure has a surface that is arcuate as seen in the three views. A plurality of vents 12 are located on the arcuate surface of the enclosure 10. Each of the vents 12 are of the type that allow adjustment of both flow and direction of the exiting air. These adjustable vents are known to one reasonably skilled in the art. Located on the front side is a switch box 14 containing switches for controlling the operation of the body freshener 10. The switches may be a single pole single throw or a push button type. Preferably the switches would be insulated to protect from electric shock.

Figure 7:
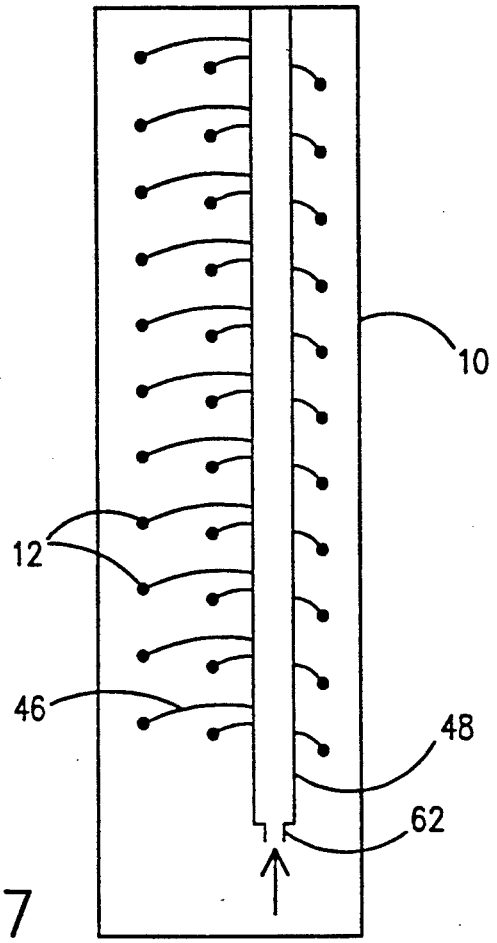
FIG. 7 shows a cut away back view of the body freshener.
Figure 6:
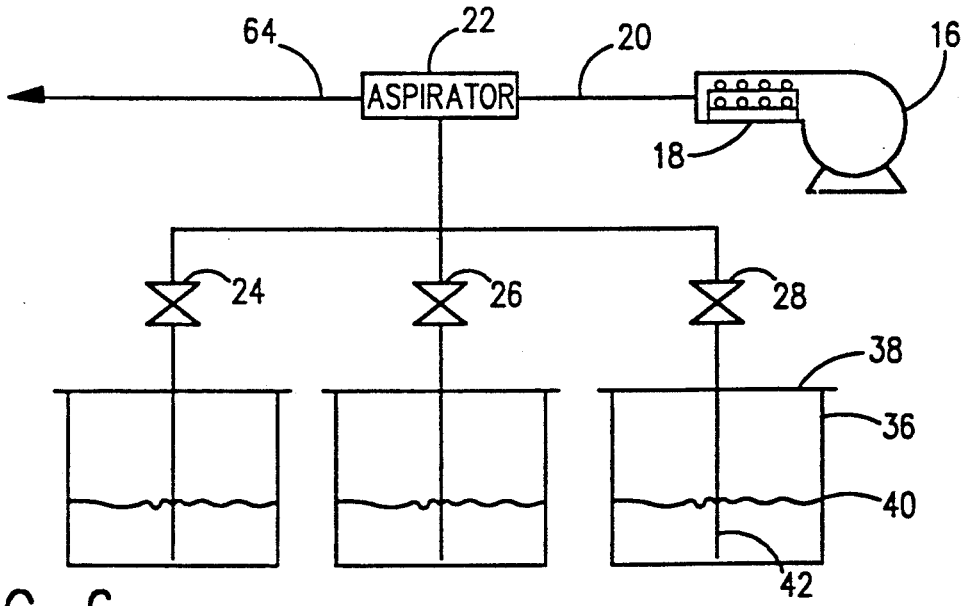
FIG. 6 shows the internals of the body freshener.

FIG. 6 shows a schematic drawing of the body freshener's internals. A blower 16 forces air through the conduit 20 to the aspirator 22. If selected by the operator, the heating element 18 will be energized and heat the air as it is discharged from the blower 16. The air from the conduit 20 passes through the aspirator 22 and exits into the header intake conduit 64. The aspirator creates a lower pressure in the header intake conduit 64 than is in the container 38. When the water on/off switch 56, or the suntan oil on/off switch 58 or the fragrance on/off switch is selected the respective solenoid valve 24, 26, or 28 opens and the lower pressure draws the liquid 40 from the container 36 up the suction pipe 42 through the open valve 28 and through the liquid feed pipe 30 to the aspirator 22, where the liquid exits through the header intake conduit 64. FIG. 7 shows a rear view of the back of the body freshener 10. The header intake conduit 64 is connected to the vent header inlet 62. The vent header 48 distributes the air or air mixture to the plurality of vents 12 by way of a plurality of vent hoses 46. The air or air mixture exits from the vents 12 on the front side of the body freshener 10. The arcuate surface of the enclosure distributes the air or air mixture in a radial pattern from the surface.

Figure 4:
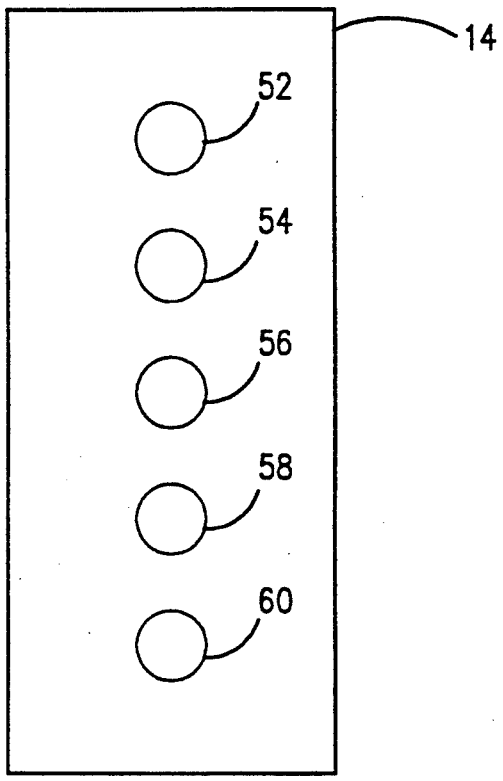
FIG. 4 shows the switch arrangement in the switch box.
Figure 5:
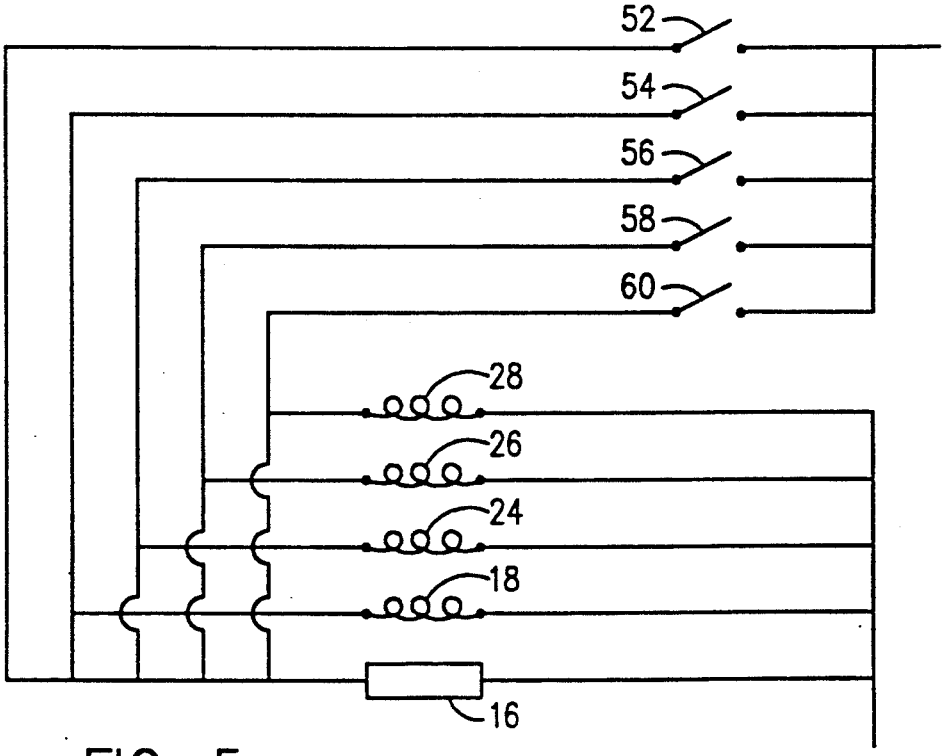
FIG. 5 shows the electrical schematic for the electric body dryer.

FIG. 4 shows the switch arrangement of the body freshener controls. The switch box 14 comprises a blower on/off switch 52, a heater on/off switch 54, a water on/off switch 56, a suntan oil switch 58, and a fragrance on/off switch 60. FIG. 5 shows a detailed electrical schematic of the body freshener. The body freshener is designed so that the operator may select an combination of air, heat, water, suntan oil, or fragrance. The blower 16 is always in operation regardless of which option is selected. The body freshener is not limited to water, suntan oil or fragrance. The containers are of suitable construction for dispensing other types of liquid substances as desired. Additional containers may be added for dispensing additional liquid substances. The body freshener enclosure is of sufficient size to allow additional containers, valves and associated piping.

The invention claimed is:

1. A body freshener comprising:

(a) an enclosure having an arcuate surface and a plurality of vents located on a front side of said surface;

(b) a means for blowing air, disposed within said enclosure, having an inlet opening, an outlet opening and a heating element;

(c) a plurality of containers for holding a liquid substance, disposed within said enclosure;

(d) an aspirator having an inlet opening, an outlet opening, and a suction opening, the inlet opening of said aspirator in fluid communication with the outlet opening of said means for blowing air and the suction opening of said aspirator in fluid communication with the liquid substance in said containers; and (e) a vent header disposed within said enclosure having at least one inlet opening and a plurality of outlet openings, each of the outlet openings of said vent header in fluid communication with each of the vents of said enclosure, and at least one inlet opening in fluid communication with the outlet opening of said aspirator.

2. The body freshener of claim 1 further comprising a plurality of fluid control means having an inlet and an outlet, the outlet of said fluid control means in fluid communication with the suction opening of said aspirator and the inlet of said fluid control means in fluid communication with the liquid substance in said container.

3. The body freshener of claim 1 further comprising adjustable vents, for directing air flow at desired angles and for selectively preventing said air flow through each of said adjustable vents.

4. The body freshener of claim 2 further comprising a control means, coupled to said heating element, said blower and said plurality of fluid control means, for selectively providing the following combinations of heat, air flow, and liquid substance: (1) unheated air flow; (2) heated air flow; (3) each of a plurality of liquid substances and unheated air flow; (4) each of a plurality of liquid substances and heated air flow.

* * * * *